US010808727B2

(12) United States Patent
Liu et al.

(10) Patent No.: US 10,808,727 B2
(45) Date of Patent: Oct. 20, 2020

(54) VENTILATION FAN WITH SPEAKER

(71) Applicant: DELTA ELECTRONICS, INC., Taoyuan (TW)

(72) Inventors: Yuan-Chuan Liu, Taoyuan (TW); Chih-Hua Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 514 days.

(21) Appl. No.: 14/755,660

(22) Filed: Jun. 30, 2015

(65) Prior Publication Data

US 2016/0029109 A1 Jan. 28, 2016

(30) Foreign Application Priority Data

Jul. 28, 2014 (TW) ..... 103125755 A

(51) Int. Cl.

| | |
|---|---|
| ***H04R 1/02*** | (2006.01) |
| ***F04D 13/06*** | (2006.01) |
| ***F04D 29/52*** | (2006.01) |
| ***F04D 29/70*** | (2006.01) |
| ***F04D 29/00*** | (2006.01) |

(52) U.S. Cl.

CPC ..... *F04D 29/703* (2013.01); *F04D 29/005* (2013.01); *H04R 1/025* (2013.01); *H04R 1/028* (2013.01); *H04R 1/023* (2013.01); *H04R 2420/07* (2013.01)

(58) Field of Classification Search

CPC ..... F04D 29/005; F04D 29/703; H04R 1/028; H04R 1/025; H04R 1/023

USPC ..... 417/313

See application file for complete search history.

(56) References Cited

U.S. PATENT DOCUMENTS

| | | | | |
|---|---|---|---|---|
| 4,720,622 | A * | 1/1988 | Iwata | A47B 77/08 219/391 |
| 5,448,495 | A * | 9/1995 | Liu | G06F 1/183 361/679.48 |
| 6,083,016 | A * | 7/2000 | Waynick, Sr. | H01R 4/2433 439/135 |
| 7,658,592 | B1 * | 2/2010 | Jarrah | F04D 29/526 415/119 |
| 8,073,182 | B2 * | 12/2011 | Li | H04R 1/025 381/386 |

(Continued)

FOREIGN PATENT DOCUMENTS

| | | |
|---|---|---|
| CN | 200947598 Y | 9/2007 |
| CN | 201219301 Y | 4/2009 |
| CN | 201730843 U | 2/2011 |

OTHER PUBLICATIONS

Author: Homewerks Worldwide Title: Bluetooth Bath Fan Installation Video Date Published: Jul. 24, 2013 Date Accessed: May 8, 2017 Link: https://www.youtube.com/watch?v=OxnLxuEYLJY.*

*Primary Examiner* — Connor J Tremarche

(74) *Attorney, Agent, or Firm* — Muncy, Geissler, Olds & Lowe, P.C.

(57) ABSTRACT

A ventilation fan includes a fan unit, a cover, a speaker and an outer cap. The fan unit has an air inlet and an air outlet. The cover is disposed on the air inlet and has an opening disposed corresponding to the air inlet. The speaker is detachably disposed on the cover. The outer cap is disposed on the air inlet. The cover is located between the fan unit and the outer cap, and the outer cap has a plurality of through holes configured as both of ventilation channels and sound output channels.

7 Claims, 10 Drawing Sheets

(56) References Cited

U.S. PATENT DOCUMENTS

| | | | | |
|---|---|---|---|---|
| 9,508,337 | B2 * | 11/2016 | Massini | G10K 11/1786 |
| 2003/0056784 | A1 * | 3/2003 | Yeung | F24C 15/20 126/299 R |
| 2003/0235186 | A1 * | 12/2003 | Park | H04M 1/2535 370/352 |
| 2010/0028134 | A1 * | 2/2010 | Slapak | F24F 13/24 415/119 |
| 2011/0255704 | A1 * | 10/2011 | Hopkins | F04D 29/665 381/71.3 |
| 2014/0064513 | A1 * | 3/2014 | Behringer | H04R 3/00 381/77 |
| 2014/0177900 | A1 * | 6/2014 | Berkman | H04R 1/021 381/391 |
| 2014/0177901 | A1 | 6/2014 | Berkman et al. | |

* cited by examiner

VENTILATION FAN WITH SPEAKER

CROSS REFERENCE TO RELATED APPLICATIONS

This Non-provisional application claims priority under 35 U.S.C. § 119(a) on Patent Application No(s). 103125755 filed in Taiwan, Republic of China on Jul. 28, 2014, the entire contents of which are hereby incorporated by reference.

BACKGROUND OF THE INVENTION

Field of Invention

The present invention relates to a ventilation fan and, in particular, to a ventilation fan with a speaker.

Related Art

For the sakes of blocking the outdoor noise and heat and remaining the indoor temperature, the buildings are usually constructed by special materials to create unventilated rooms. Accordingly, a proper ventilation mechanism is required to exhaust the harmful contaminates.

In order to improve the air convection in the rooms, many buildings installed ventilation fans for supplying the fresh air. However, the conventional ventilation fan only has the ventilation function, and the operation environment thereof is limited.

SUMMARY OF THE INVENTION

This invention discloses a ventilation fan including a fan unit, a cover and a speaker. The fan unit has an air inlet and an air outlet. The cover is disposed on the air inlet and has an opening disposed corresponding to the air inlet. The speaker is detachably disposed on the cover.

In one embodiment, the cover has two locking members disposed opposite to each other, and the speaker is slidingly disposed on the locking members so as to be installed on the cover. The speaker has two slots corresponding to the locking members of the cover.

In one embodiment, the cover has at least a first engaging portion, and the speaker has at least a second engaging portion corresponding to the first engaging portion. The speaker is installed on the cover by the first and second engaging portions.

In one embodiment, the ventilation fan further includes a power supply wire having a connecting terminal, and the speaker has a power socket. The connecting terminal is inserted into the power socket so that the speaker and the fan unit share a single power source.

In one embodiment, the cover has a moisture-proof socket. When the speaker is detached from the cover, the connecting terminal is inserted in the moisture-proof socket.

In one embodiment, the speaker has a battery set for providing power to the speaker.

In one embodiment, the speaker is connected to a power adaptor for receiving an external power source.

In one embodiment, the ventilation fan further includes an outer cap disposed on the air inlet, and the cover is located between the fan unit and the outer cap.

In one embodiment, the outer cap has a plurality of through holes configured as both of ventilation channels and sound output channels of the speaker.

In one embodiment, the outer cap is disposed on the air inlet by at least an elastic member.

In one embodiment, the speaker has a wireless communication module.

In one embodiment, the wireless communication module is a Bluetooth wireless communication module.

The present invention also discloses a ventilation fan including a fan unit and a speaker. The fan unit has a volute casing, which has an air inlet and an air outlet. The speaker is detachably disposed on the volute casing.

In one embodiment, the volute casing has at least a first engaging portion, and the speaker has at least a second engaging portion corresponding to the first engaging portion. The speaker is installed on the volute casing by the first and second engaging portions.

In one embodiment, the ventilation fan further includes a power supply wire having a connecting terminal, and the speaker has a power socket. The connecting terminal is inserted into the power socket so that the speaker and the fan unit share a single power source.

In one embodiment, the speaker has a battery set for providing power to the speaker.

In one embodiment, the speaker is connected to a power adaptor for receiving an external power source.

In one embodiment, the ventilation fan further includes an outer cap disposed on the air inlet, and the speaker is located between the fan unit and the outer cap.

In one embodiment, the outer cap has a plurality of through holes configured as both of ventilation channels and sound output channels of the speaker.

In one embodiment, the outer cap is disposed on the air inlet by at least an elastic member.

In one embodiment, the speaker has a wireless communication module.

In one embodiment, the wireless communication module is a Bluetooth wireless communication module.

The present invention further discloses a ventilation fan including a fan unit, an outer cap and a speaker. The fan unit has an air inlet and an air outlet. The outer cap is disposed on the air inlet and has a plurality of through holes. The speaker is detachably disposed on the outer cap. The speaker is located between the fan unit and the outer cap, and the through holes are configured as both of ventilation channels and sound output channels of the speaker.

In one embodiment, the outer cap has two locking members disposed opposite to each other, and the speaker is slidingly disposed on the locking members so as to be installed on the outer cap.

In one embodiment, the speaker has two slots corresponding to the locking members of the outer cap.

In one embodiment, the outer cap has at least a first engaging portion, and the speaker has at least a second engaging portion corresponding to the first engaging portion. The speaker is installed on the outer cap by the first and second engaging portions.

In one embodiment, the ventilation fan further includes a power supply wire having a connecting terminal, and the speaker has a power socket. The connecting terminal is inserted into the power socket so that the speaker and the fan unit share a single power source.

In one embodiment, the speaker has a battery set, and the battery set provides power to the speaker.

In one embodiment, the speaker is connected to a power adaptor for receiving an external power source.

In one embodiment, the outer cap is disposed on the air inlet by at least an elastic member.

In one embodiment, the speaker has a wireless communication module.

In one embodiment, the wireless communication module is a Bluetooth wireless communication module.

As mentioned above, the ventilation fan of the invention is combined with a speaker. Accordingly, the ventilation fan can provide the normal ventilation function and an additional music playing function. In addition, the speaker is detachable, so that it can individually operate after being detached from the ventilation fan.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
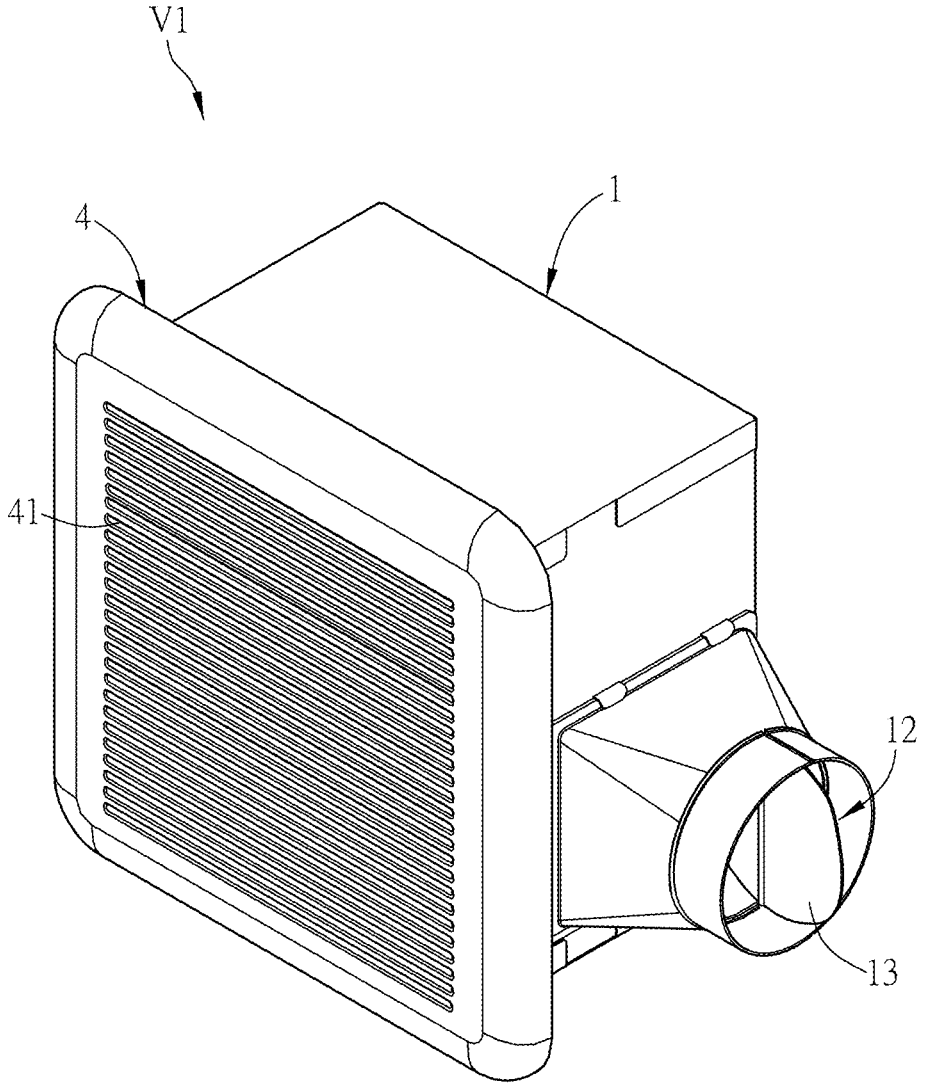
FIG. 1A is a schematic diagram of a ventilation fan according to a first embodiment of the invention.
Figure 1B:
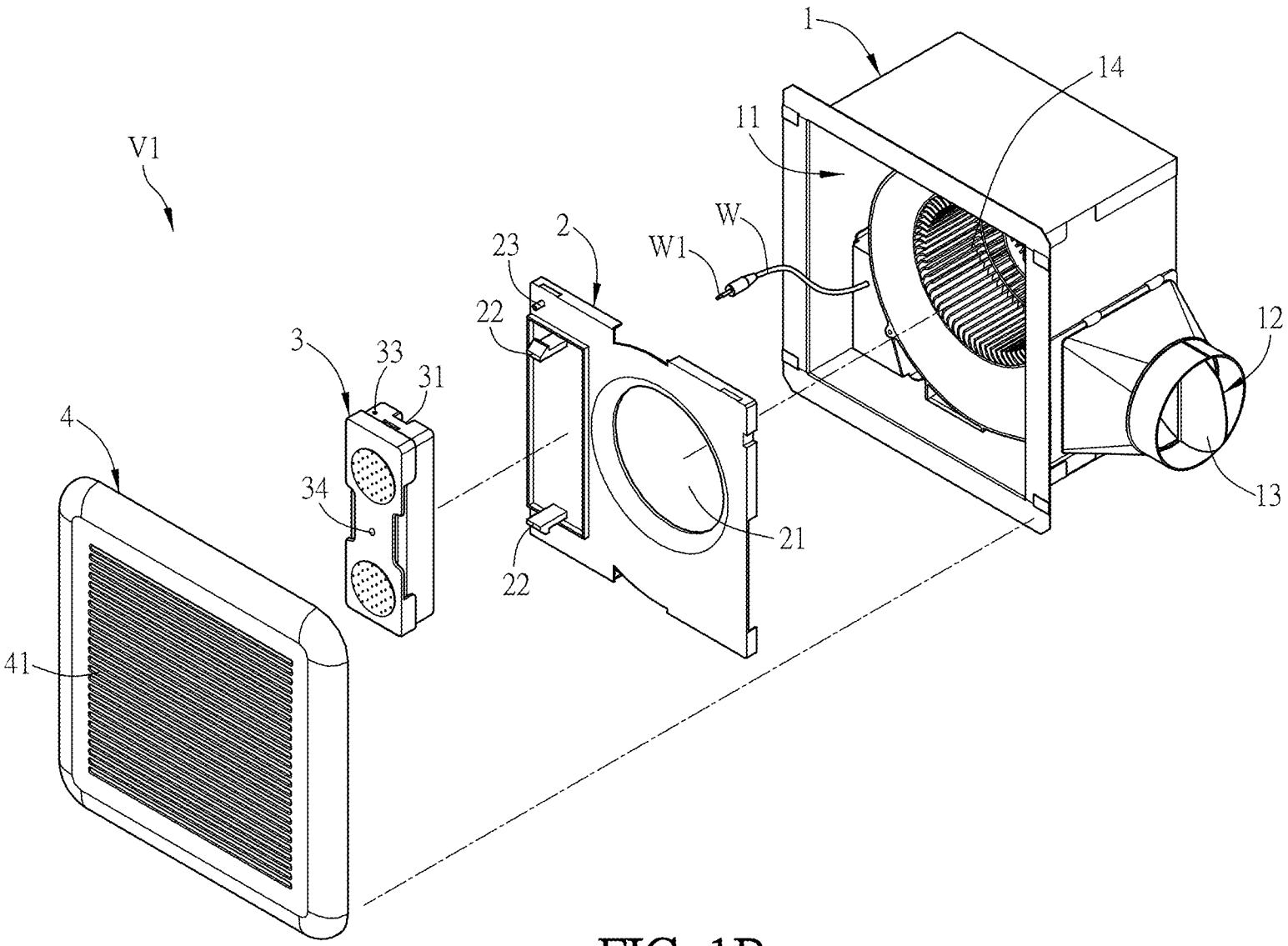
FIG. 1B is an exploded view of the ventilation fan of FIG. 1A.

FIG. 1A is a schematic diagram of a ventilation fan V1 according to a first embodiment of the invention, and FIG. 1B is an exploded view of the ventilation fan V1 of FIG. 1A. Referring to FIGS. 1A and 1B, the ventilation fan V1 includes a fan unit 1, a cover 2 and a speaker 3. Preferably, the ventilation fan V1 further incudes an outer cap 4. The ventilation fan V1 of this embodiment is installed at indoors, such as the bedroom, bathroom, toilet, kitchen, or the likes, for sending the indoor air to the outdoor so as to facilitate the air convection. In practice, the ventilation fan V1 is installed on the ceiling, and the outer cap 4 is disposed facing the floor.

The fan unit 1 has an air inlet 11 and an air outlet 12. In this embodiment, the fan unit 1 further includes a motor (not shown) and at least one blade 14. The motor connects to the blade 14 and drives it to rotate, so that the external air can be brought in through the air inlet 11 and then ejected out through the air outlet 12. In this embodiment, the air outlet 12 is further configured with a block plate 13, which is pivotally installed around the air outlet 12 by a shaft. When the ventilation fan V1 operates to create the airflow from the air inlet 11 to the air outlet 12, the airflow will push and open the block plate 13 and then leave the fan unit 1. When the ventilation fan V1 is not in operation, the block plate 13 can close the air outlet 12 so as to prevent the reverse airflow.

The cover 2 is disposed on the air inlet 11 and has an opening 21. In this embodiment, the opening 21 is a circular opening and is disposed corresponding to the air inlet 11. The opening 21 can be configured with a filter (not shown) for filtering the dusts in the air, thereby reducing the risk of the motor in the fan unit 1 being affected by the dusts.

Figure 2A:
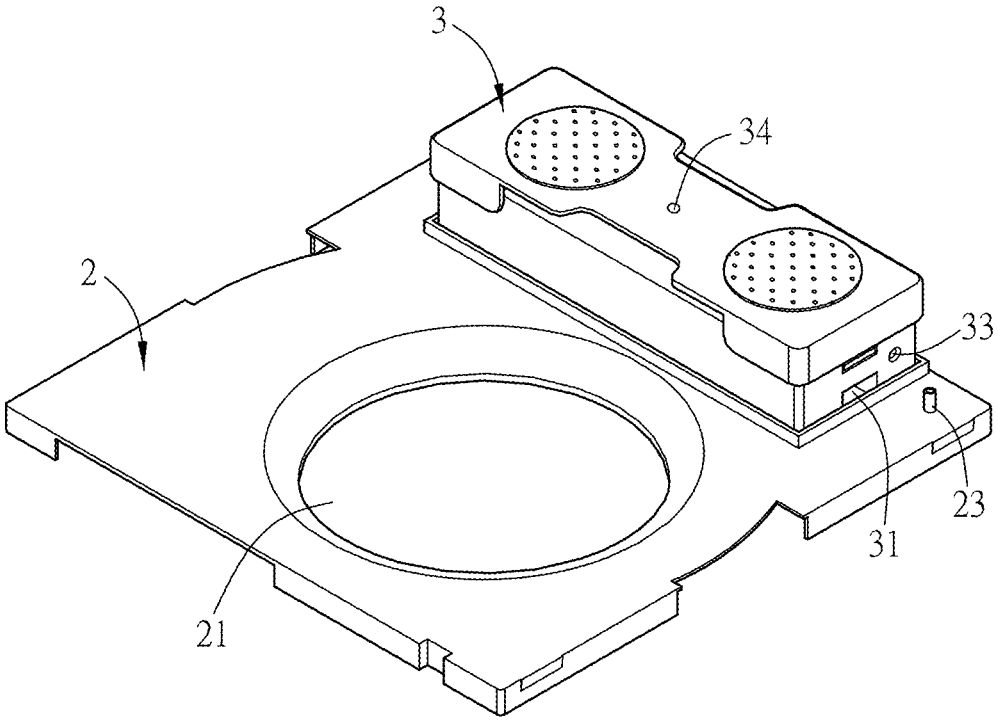
FIG. 2A is a schematic diagram showing assembled speaker and cover.
Figure 2B:
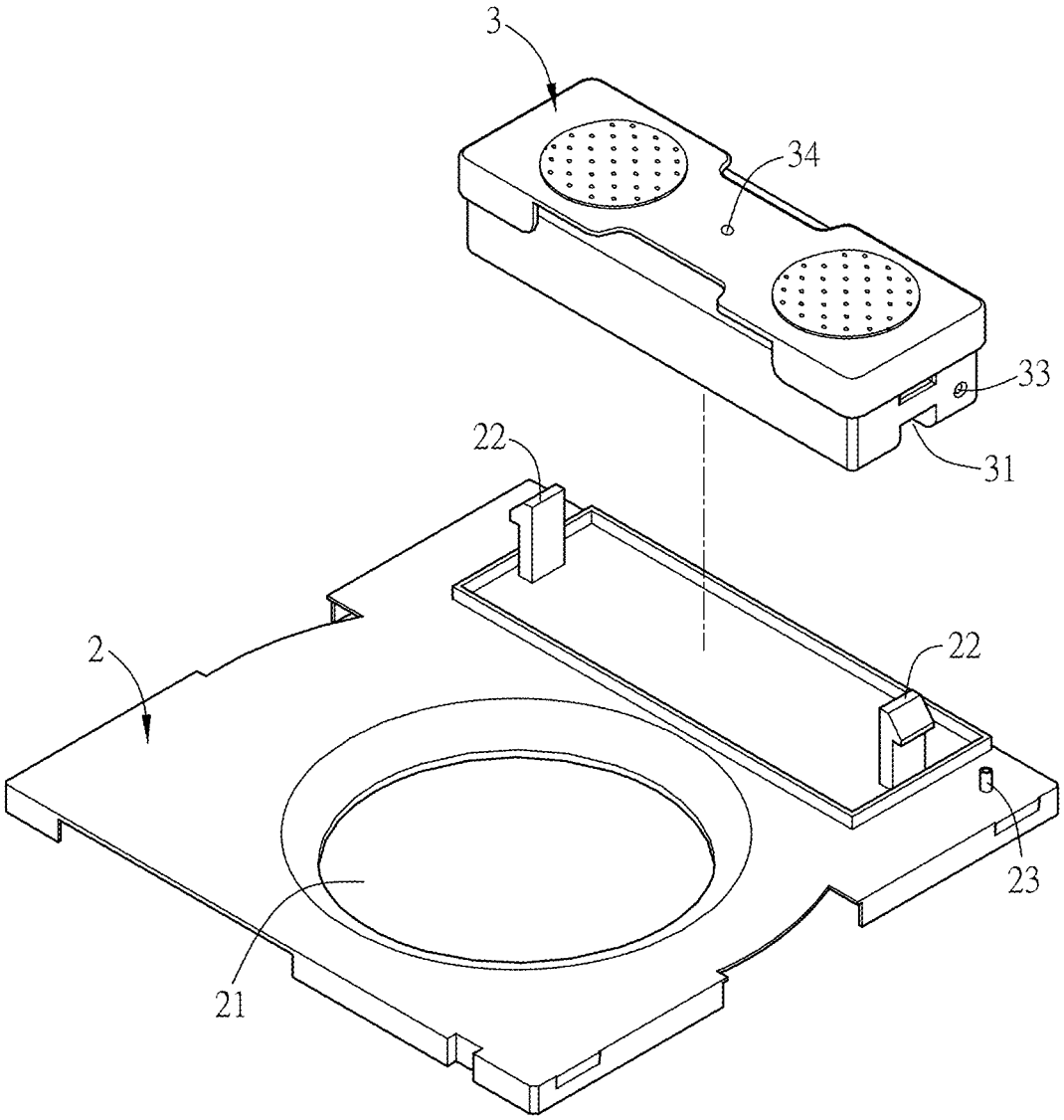
FIG. 2B is a schematic diagram showing detached speaker and cover.

FIG. 2A is a schematic diagram showing assembled speaker 3 and cover 2, and FIG. 2B is a schematic diagram showing detached speaker 3 and cover 2. As shown in FIGS. 2A and 2B, the speaker 3 is detachably disposed on the cover 2. In this embodiment, the cover 2 has two first engaging portions 22, and the speaker 3 has two second engaging portions 31 corresponding to the first engaging portions 22, respectively. The speaker 3 is installed on the cover 2 by the first and second engaging portions 22, 31. The first engaging portion 22 can engage with and detach from the corresponding second engaging portion 31, so that the speaker 3 can be separated from cover 2 and operated individually. The number of the engaging portions is not limited in this embodiment, and the consideration is to firmly install the speaker 3 on the cover 2.

The speaker 3 has a wireless communication module for performing wireless communication with an external device (not shown). For example, the external device is a smart phone, tablet computer, notebook computer, desktop computer, or any device capable of communicating with the speaker 3. In this embodiment, the wireless communication module is a Bluetooth wireless communication module. The user can operate the external device to transmit the music signal or radio signal to the speaker 3 through Bluetooth, and then the speaker 3 can output the music or broadcast. For example, when the ventilation fan V1 is installed in the bathroom, the user can use the smart phone to setup the music playing list and the speaker 3 will start to play the music. Accordingly, the user can listen to the music while taking a bath.

To be noted, when the speaker 3 is detached from the ventilation fan V1, it can be used as a wireless speaker. For example, the speaker 3 can connect to the smart phone and thus be used as a bedside audio in the bedroom, or the speaker 3 can connect to the notebook computer and thus be used as a computer speaker in the study room. Since the speaker 3 is detachable, it can be combined with the ventilation fan V1 or be separated from the ventilation fan V1. Accordingly, the speaker 3 can be used as a wireless speaker without being limited by the install position of the ventilation fan V1, so the speaker 3 can have different operation modes.

Figure 3:
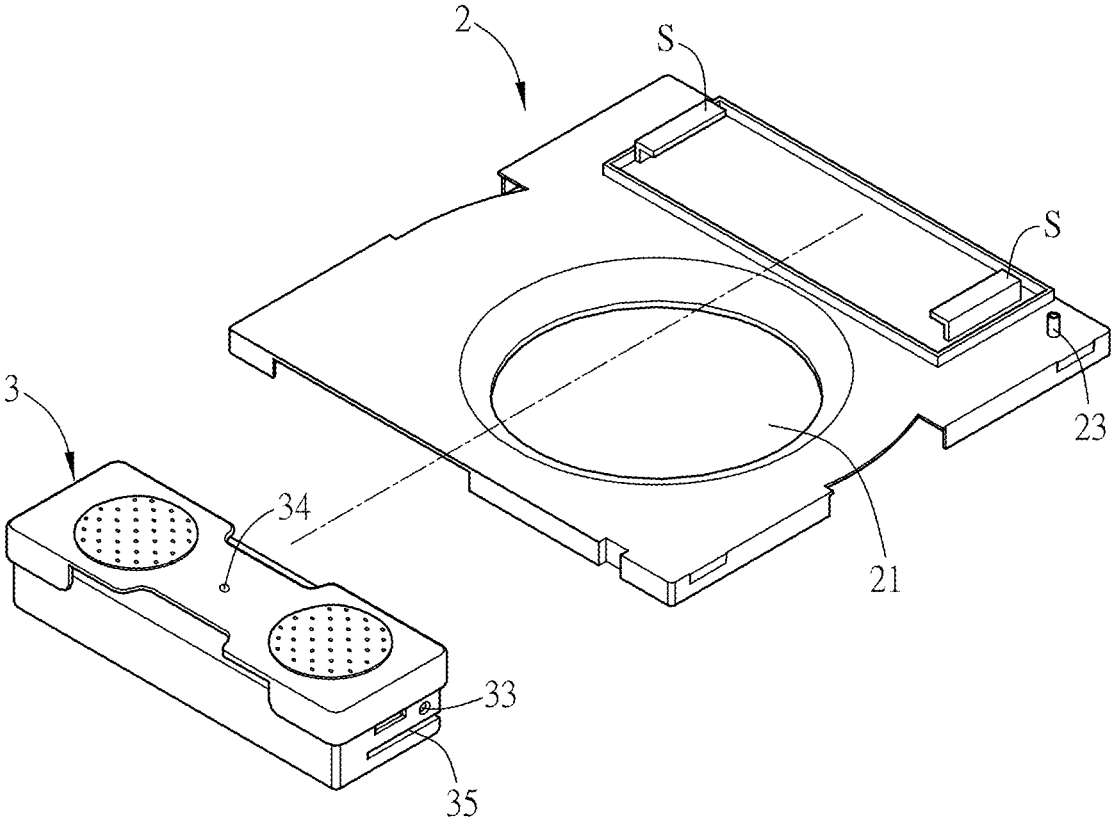
FIG. 3 is a schematic diagram showing another arrangement of the cover and the speaker.

FIG. 3 is a schematic diagram showing another arrangement of the cover 2 and the speaker 3. Referring to FIG. 3, the cover 2 and the speaker 3 can be connected by locking members and slots. In more detailed, the cover 2 has two locking members S disposed opposite to each other, and the speaker 3 has two slots 35 for slidingly connecting to the locking members S so as to be installed on the cover 2. Of course, the configuration of the locking members S and the slots 35 also allows the speaker 3 to be detachable from the cover 2.

Figure 4:
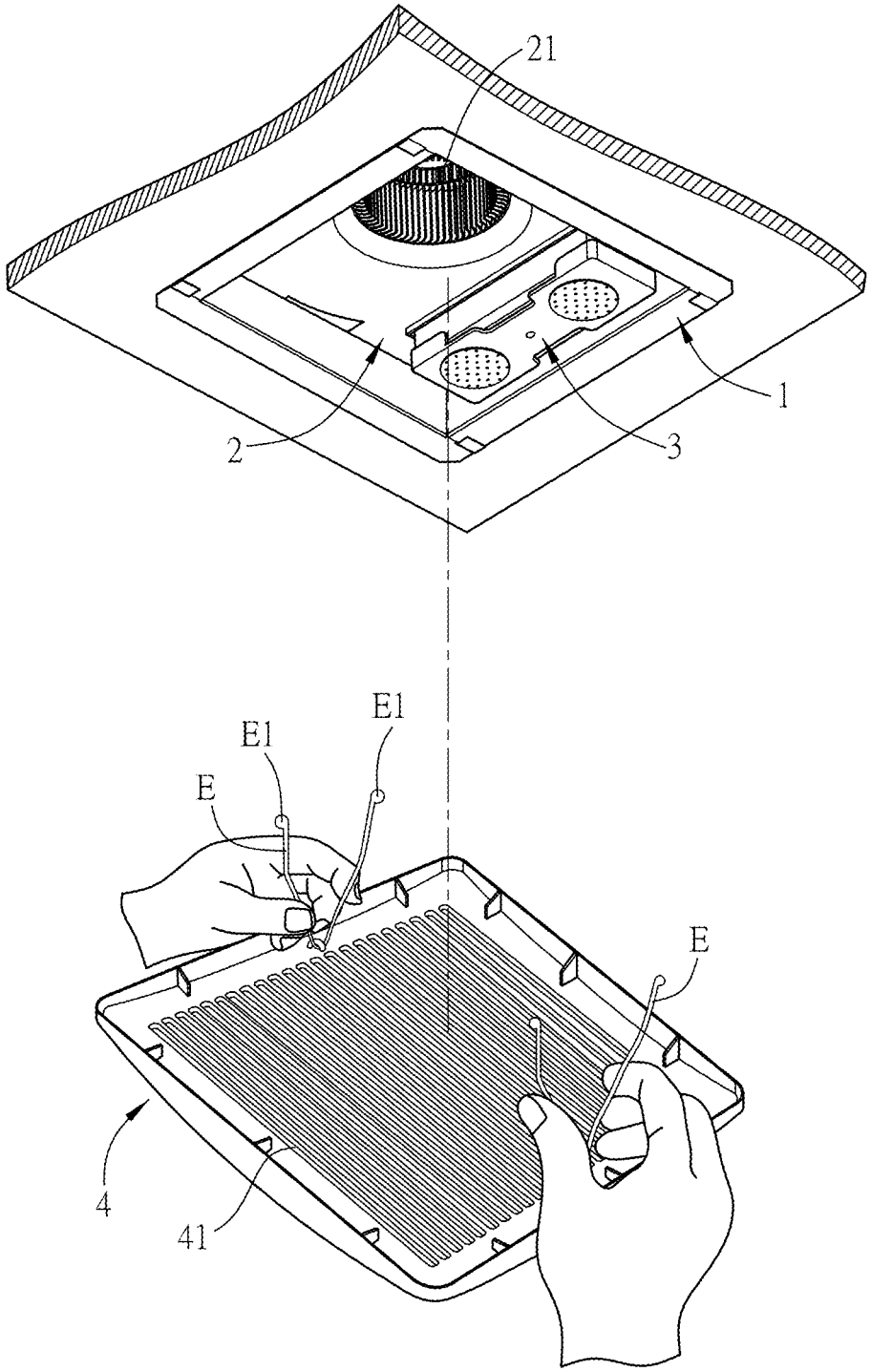
FIG. 4 is a schematic diagram showing an outer cap disposed on the air inlet.

FIG. 4 is a schematic diagram showing an outer cap 4 disposed on the air inlet 11. In FIG. 4, the ventilation fan is installed on the ceiling. With reference to FIGS. 1B and 4, the cover 2 is disposed between the fan unit 1 and the outer cap 4, and the opening 21 is used as an airflow channel. The outer cap 4 can cover the speaker 3 and the fan unit 1. When the ventilation fan is installed in the bathroom, the outer cap 4 can prevent the speaker 3 from exposing in the moisture environment. In addition, the outer cap 4 has a plurality of through holes 41 for filtering the dusts in air. The through holes can be a grid structure as shown in the figure, and they can be used as both of ventilation channels and sound output channels of the speaker 3. Besides, the shape of the through holes 41 can also be square, circle or other shapes, and they can be arranged in parallel or irregularly. This invention is not limited.

Referring to FIG. 4, the outer cap 4 is disposed on the air inlet 11 by at least one elastic member E. In this embodiment, the elastic member E is substantially a V-shaped metal element, and the bending portion thereof is connected to the outer cap 4 while the two end portions thereof have hook structures E1, respectively. When installing the outer cap 4 on the air inlet 11 of the fan unit 1, the elastic member E passes through the fan unit 1 and the hook structures E1 can fix the fan unit 1. When removing the outer cap 4, the user can directly pull out the outer cap 4 so as to uninstall it without any assistant tool. Accordingly, the speaker 3 can also be easily uninstalled. Due to the configuration of the elastic member E, the outer cap 4 can be still hanged on the fan unit 1 by the hook structures E1 during the procedure of removing the outer cap 4. If it is desired to completely remove the outer cap 4, the user can simply press the elastic member E to release it from the hook structures E1.

Figure 5A:
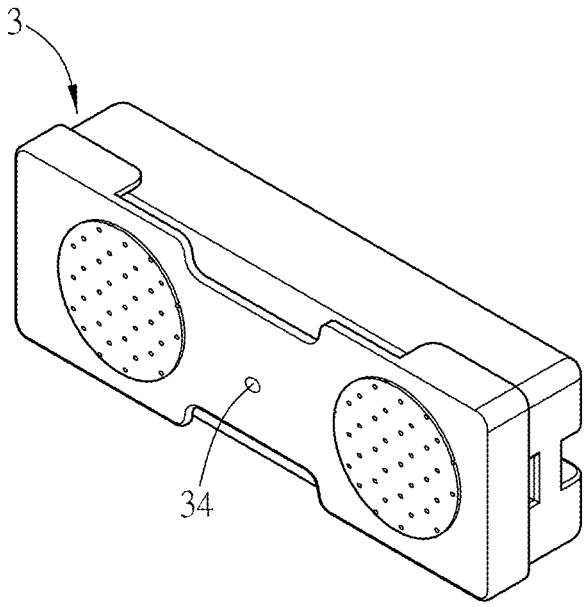
FIGS. 5A and 5B are schematic diagrams showing the speaker viewed from different angles.
Figure 5B:
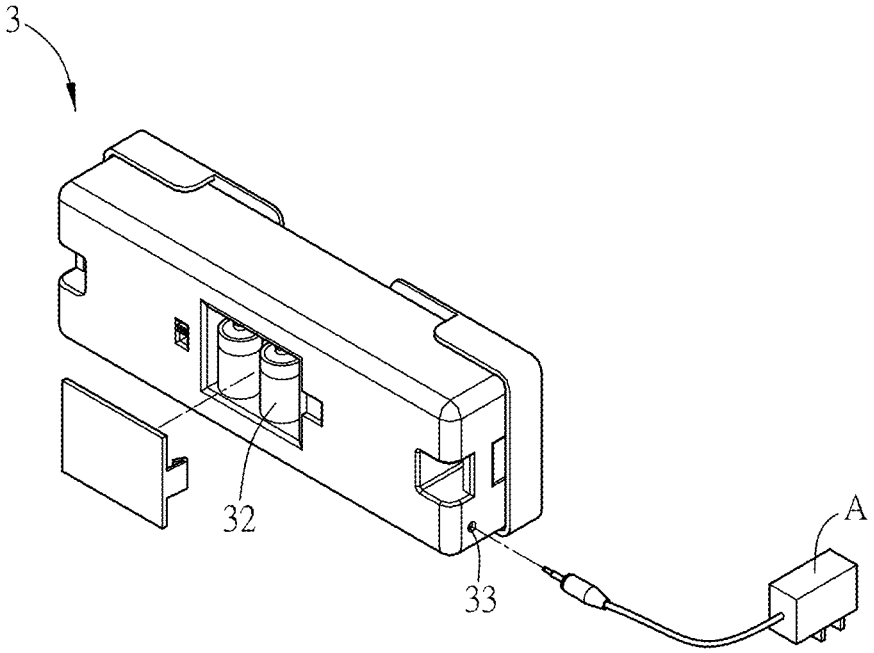

FIGS. 5A and 5B are schematic diagrams showing the speaker 3 viewed from different angles. Referring to FIGS. 5A and 5B, the speaker 3 of this embodiment further has a battery set 32. The battery set 32 is disposed in an accommodating slot or is installed in a peripheral battery box. Accordingly, the battery set 32 can provide power to the speaker 3.

Referring to FIGS. 1B and 5B, the speaker 3 further has a power socket 33, which can connect to a power adaptor A for receiving an external power source (e.g. the city electricity). Besides, the ventilation fan V1 further includes a power supply wire W having a connecting terminal W1. The power supply wire W is, for example, a wire or cable extending from the power source of the fan unit 1. The connecting terminal W1 is inserted into the power socket 33 of the speaker 3, so that the speaker 3 and the fan unit 1 share a single power source. In brief, when the speaker 3 is installed on the cover 2, it can use the power source of the fan unit 1 through the power supply wire W. No matter the speaker 3 is installed to or separated from the cover 2, it can be driven by the battery set 32 or an external power source through the power adaptor A. In this case, the user can choose any method for supplying power to the speaker 3.

To be noted, the cover 2 may have a moisture-proof socket 23. Referring to FIGS. 1B and 2A, the moisture-proof socket 23 of this embodiment is a cylinder structure, which extends toward the outer cap 4 from the cover 2. When the speaker 3 is detached from the cover 2, the connecting terminal W1 of the power supply wire W can be inserted in the moisture-proof socket 23. This configuration can prevent the connecting terminal W1 from exposing and wetting, and the moisture-proof socket 23 can also provide a dustproof function. Of course, in other embodiments, the moisture-proof socket 23 can be a hole formed on the cover 2.

With reference to FIG. 5A, the speaker 3 includes an indicator lamp 34. When the speaker 3 does not connect to the external device (e.g. a smart phone) by wireless communication, the indicator lamp 34 shows a first signal (e.g. a red light or no light). When the speaker 3 connects to the external device by wireless communication, the indicator lamp 34 shows a second signal (e.g. a green light). After building the wireless communication, the indicator lamp 34 may show a third signal during data transmission, such as a flash light or another color light. Accordingly, the user can judge the wireless connection status of the speaker 3 based on the signal shown by the indicator lamp 34.

Figure 6:
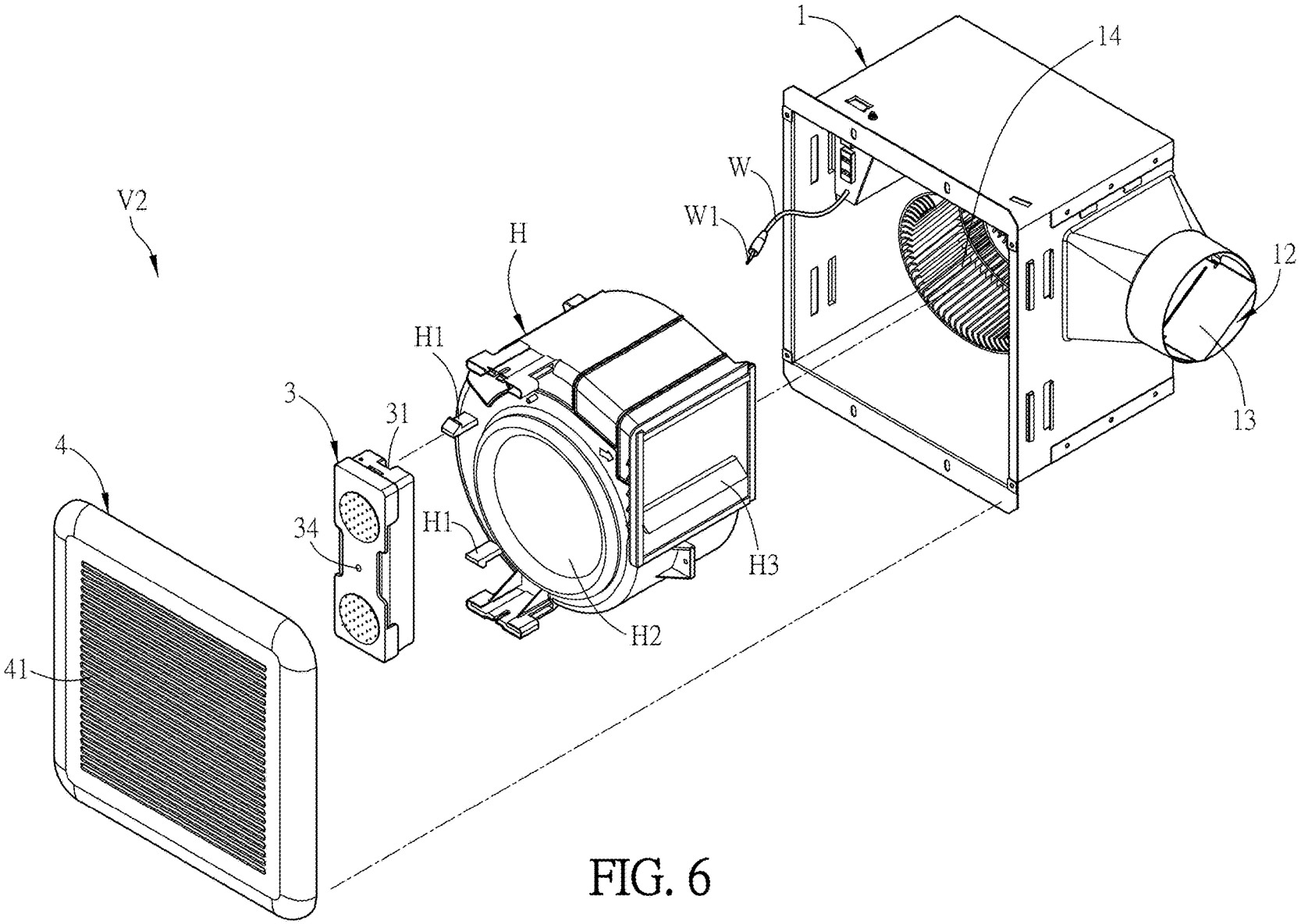
FIG. 6 is an exploded view of a ventilation fan according to a second embodiment of the invention.

FIG. 6 is an exploded view of a ventilation fan V2 according to a second embodiment of the invention. Referring to FIG. 6, the fan unit 1 of the ventilation fan V2 has a volute casing H, which has an air inlet H2 and an air outlet H3. The air outlet H3 of the volute casing H is disposed corresponding to the air outlet 12 of the fan unit 1. Different from the first embodiment, the speaker 3 of the second embodiment is detachably disposed on the volute casing H.

In more detailed, the volute casing H has two first engaging portions H1, and the speaker 3 has two second engaging portions 31 corresponding to the first engaging portions H1, respectively. In this embodiment, the ventilation fan V2 does not include a cover, and the speaker 3 is installed on the volute casing H. This configuration can increase the available space inside the ventilation fan V2. Of course, in some embodiments, the ventilation fan V2 may also include a cover disposed on the air inlet 11, and the speaker 3 is disposed between the fan unit 1 and the cover. The other components can be referred to the first embodiment, so the detailed description thereof will be omitted.

Figure 7A:
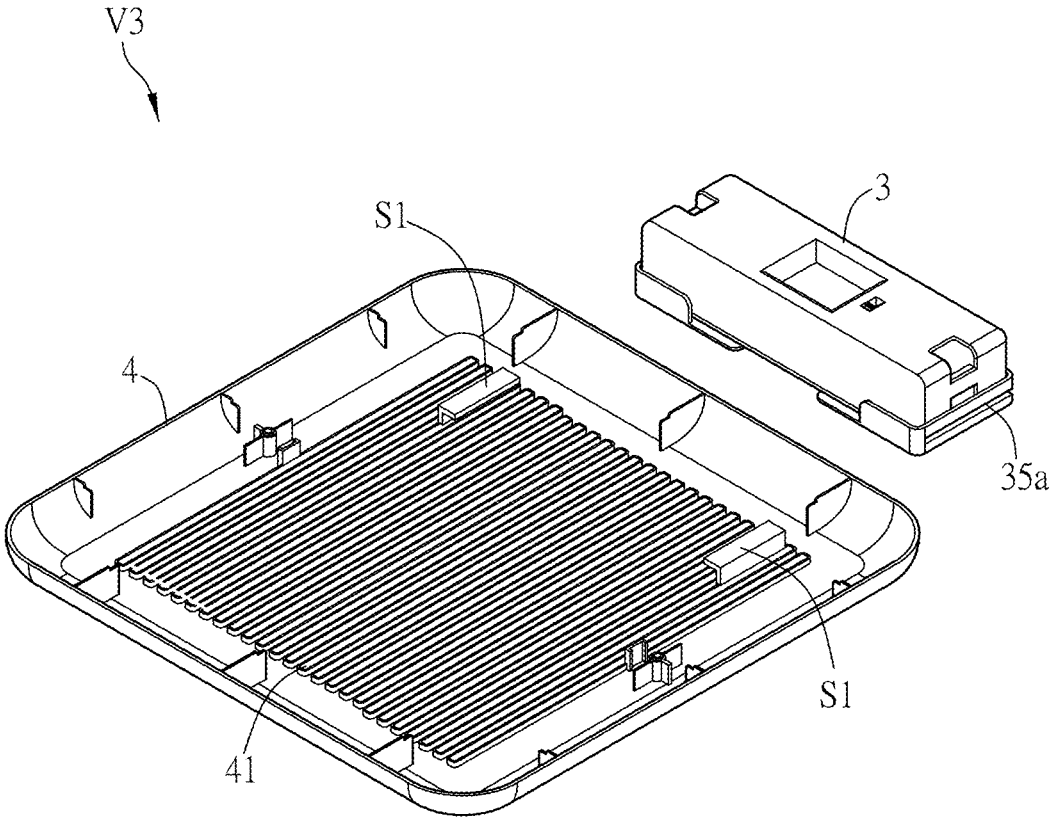
FIG. 7A is an exploded view of a ventilation fan according to a third embodiment of the invention.
Figure 7B:
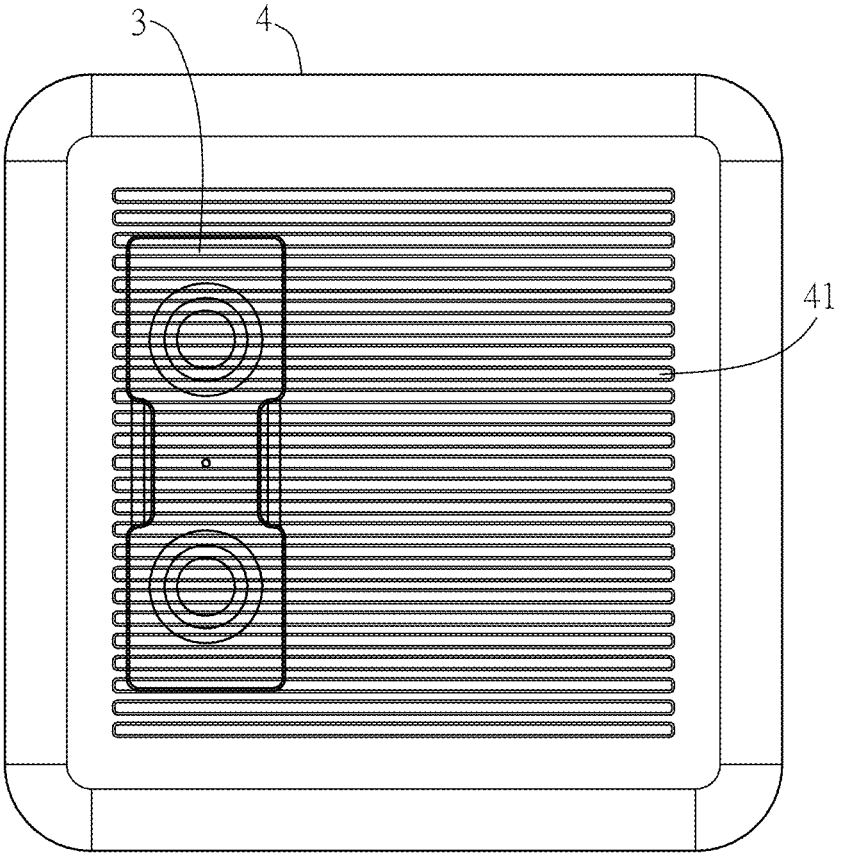
FIG. 7B is a front view of the assembled ventilation fan of FIG. 7A.

FIG. 7A is an exploded view of a ventilation fan V3 according to a third embodiment of the invention, and FIG. 7B is a front view of the assembled ventilation fan V3 of FIG. 7A. To be noted, the speaker 3 of the ventilation fan V3 of the third embodiment is detachably disposed on the outer cap 4. In order to make the figures more simple and clear, only the speaker 3 and the outer cap 4 are shown in the figures.

Referring to FIGS. 7A and 7B, the inner side of the outer cap 4 has two locking members S1 disposed opposite to each other, and the speaker 3 has slots 35*a* for being slidingly disposed on the locking members S1 so as to be installed on the outer cap 4. Similarly, the speaker 3 has engaging portions for disposing on the outer cap 4. For example, the outer cap 4 may have first engaging portions (not shown), and the speaker 3 can be installed on the outer cap 4 by the first and second engaging portions (not shown). In this case, when the user uninstalls the outer cap 4 of the ventilation fan V3, the speaker 3 is carried by the outer cap 4 and thus detached from the ceiling. Thus, the user can easily separate the speaker 3. The other components can be referred to the first embodiment, so the detailed description thereof will be omitted.

In summary, the ventilation fan of the invention is combined with a speaker. Accordingly, the ventilation fan can provide the normal ventilation function and an additional music playing function. In addition, the speaker is detachable, so that it can individually operate after being detached from the ventilation fan.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A ventilation fan, comprising:

a fan unit having a volute casing, wherein the volute casing has an air inlet and an air outlet;

a speaker directly and detachably disposed outside the volute casing, and disposed beside and outside the air inlet; and an outer cap disposed on the air inlet, wherein the speaker is located between the fan unit and the outer cap, and the outer cap has a plurality of through holes, wherein each of the through holes is configured as both of an output channel of the speaker and a ventilation channel, and the through holes communicate with each other.

2. The ventilation fan of claim 1, wherein the volute casing has at least a first engaging portion, the speaker has at least a second engaging portion corresponding to the first engaging portion, and the speaker is installed on the volute casing by the first and second engaging portions.

3. The ventilation fan of claim 1, further comprising a power supply wire having a connecting terminal, wherein the speaker has a power socket, and the connecting terminal is inserted into the power socket so that the speaker and the fan unit share a single power source.

4. The ventilation fan of claim 1, wherein the speaker has a battery set, and the battery set provides power to the speaker.

5. The ventilation fan of claim 1, wherein the speaker is connected to a power adaptor for receiving an external power source.

6. The ventilation fan of claim 1, wherein the outer cap is disposed on the air inlet by at least an elastic member.

7. The ventilation fan of claim 1, wherein the speaker has a Bluetooth wireless communication module.

* * * * *